US005359927A

United States Patent [19]

Demeyer

[11] Patent Number: 5,359,927

[45] Date of Patent: Nov. 1, 1994

[54] WIRE STRIPER

[76] Inventor: Richard G. Demeyer, 7 Inwood Dr., West Milford, N.J. 07480

[21] Appl. No.: 138,723

[22] Filed: Oct. 20, 1993

[51] Int. Cl.[5] ..... B41F 17/00

[52] U.S. Cl. ..... 101/35; 101/41

[58] Field of Search ..... 101/35, 41, 44, 4; 29/33 M; 30/90.1

[56] References Cited

U.S. PATENT DOCUMENTS

| | | | |
|---|---|---|---|
| 1,944,259 | 1/1934 | Moore | 101/4 |
| 2,561,947 | 7/1951 | Premo | 101/4 |
| 3,225,629 | 12/1965 | Horrocks | 30/90.1 |
| 4,269,090 | 5/1981 | Ingber et al. | 101/4 |
| 4,463,494 | 8/1984 | Bianco, Jr. | 30/92.5 |

*Primary Examiner*—Edgar S. Burr
*Assistant Examiner*—Anthony H. Nguyen
*Attorney, Agent, or Firm*—E. Michael Combs

[57] ABSTRACT

A device to permit the individual striping and indication by means of color coding wires is provided, such that a guide tube receives a wire therethrough, with a guide housing mounted to the guide tube and the guide housing having a first end arranged in surrounding relationship relative to an opening in the guide tube to permit a felt tip marker tip portion to project through the opening and permit striping of a wire directed through the guide tube.

5 Claims, 4 Drawing Sheets

WIRE STRIPER

BACKGROUND OF THE INVENTION

1. Field of the Invention

The field of invention relates to indicator apparatus, and more particularly pertains to a new and improved wire striper permitting the color coding of, electrical wire and the like.

2. Description of the Prior Art

Wire marking apparatus of various types is indicated in the prior art and typically by complex structure such as indicated in U.S. Pat. No. 5,067,399.

The instant invention attempts to overcome deficiencies of the prior art by providing for a guide housing structure permitting the ease of striping and the indication of wire directed through the apparatus and to this end, the present invention substantially fulfills this need.

SUMMARY OF THE INVENTION

In view of the foregoing disadvantages inherent in the known types of wire coding apparatus now present in the prior art, the present invention provides a wire striper wherein the same is arranged to effect the striping of wire directed through the guide tube organization of the housing. As such, the general purpose of the present invention, which will be described subsequently in greater detail, is to provide a new and improved wire striper which has all the advantages of the prior art wire marking structure and none of the disadvantages.

To attain this, the present invention provides a device to permit the individual striping and indication by means of color coding wires, such that a guide tube receives a wire therethrough, with a guide housing mounted to the guide tube and the guide housing having a first end arranged in surrounding relationship relative to art opening in the guide tube to permit a felt tip marker tip portion to propject through the opening and permit striping of a wire directed through the guide tube.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wire striper which has all the advantages of the prior art wire coding apparatus and none of the disadvantages.

It is another object of the present invention to provide a new and improved wire striper which may be easily and efficiently manufactured and marketed.

It is a further object of the present invention to provide a new and improved wire striper which is of a durable and reliable construction.

An even further object of the present invention is to provide a new and improved wire striper which is susceptible of a low cost of manufacture with regard to both materials and labor, and which accordingly is then susceptible of low prices of sale to the consuming public, thereby making such wire stripers economically available to the buying public.

Still yet another object of the present invention is to provide a new and improved wire striper which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
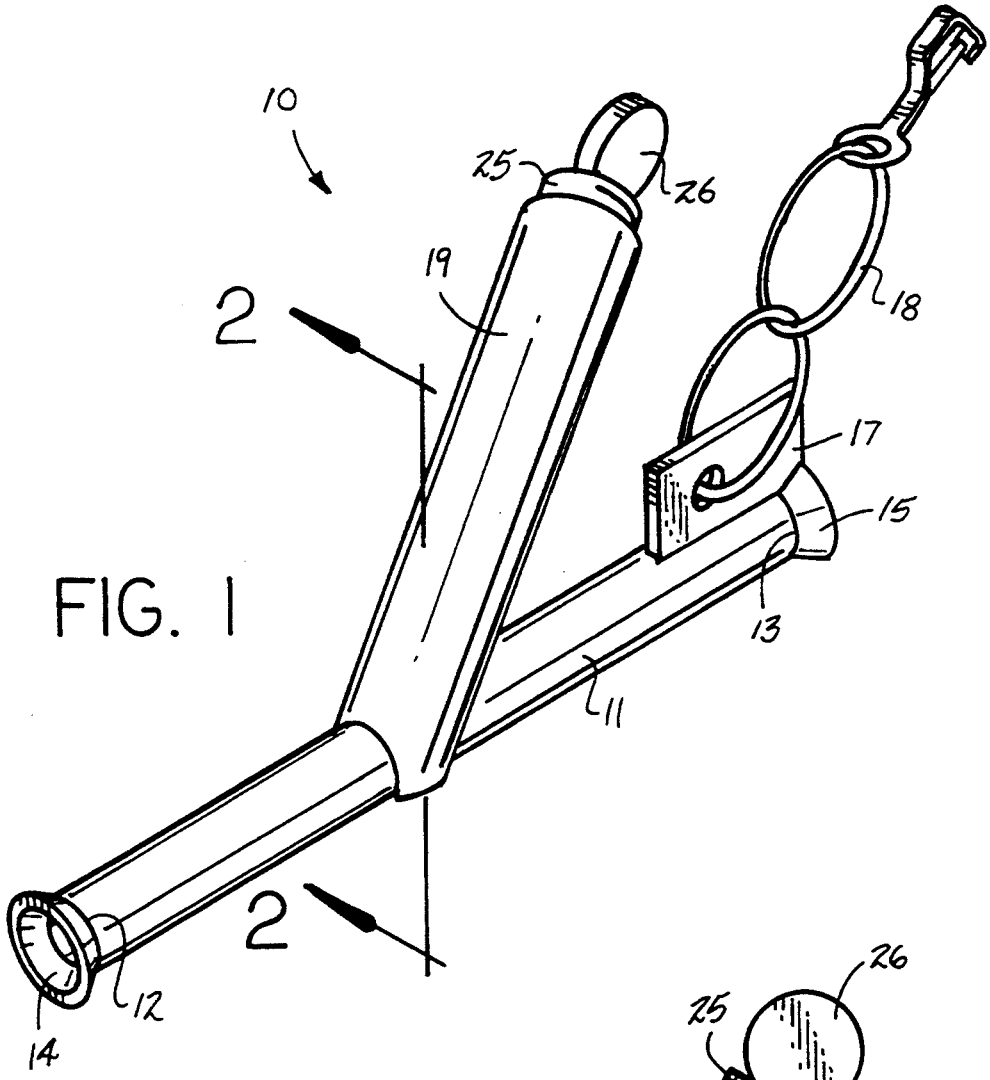
FIG. 1 is an isometric illustration of the invention.

With reference now to the drawings, and in particular to FIGS. 1 to 7 thereof, a new and improved wire striper embodying the principles and concepts of the present invention and generally designated by the reference numerals 10 and 10a will be described.

Figure 2:
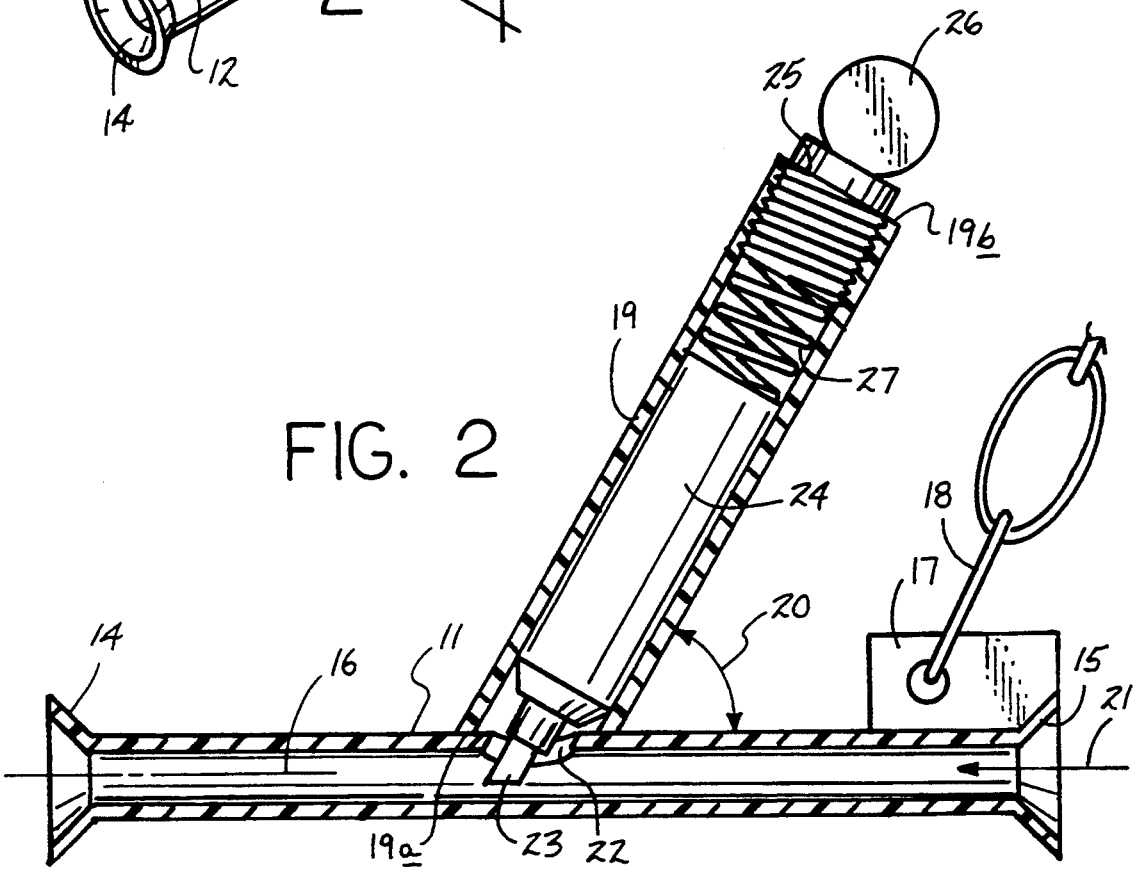
FIG. 2 is an orthographic view, taken along the lines 2—2 of FIG. 1 in the direction indicated by the arrows.
Figure 3:
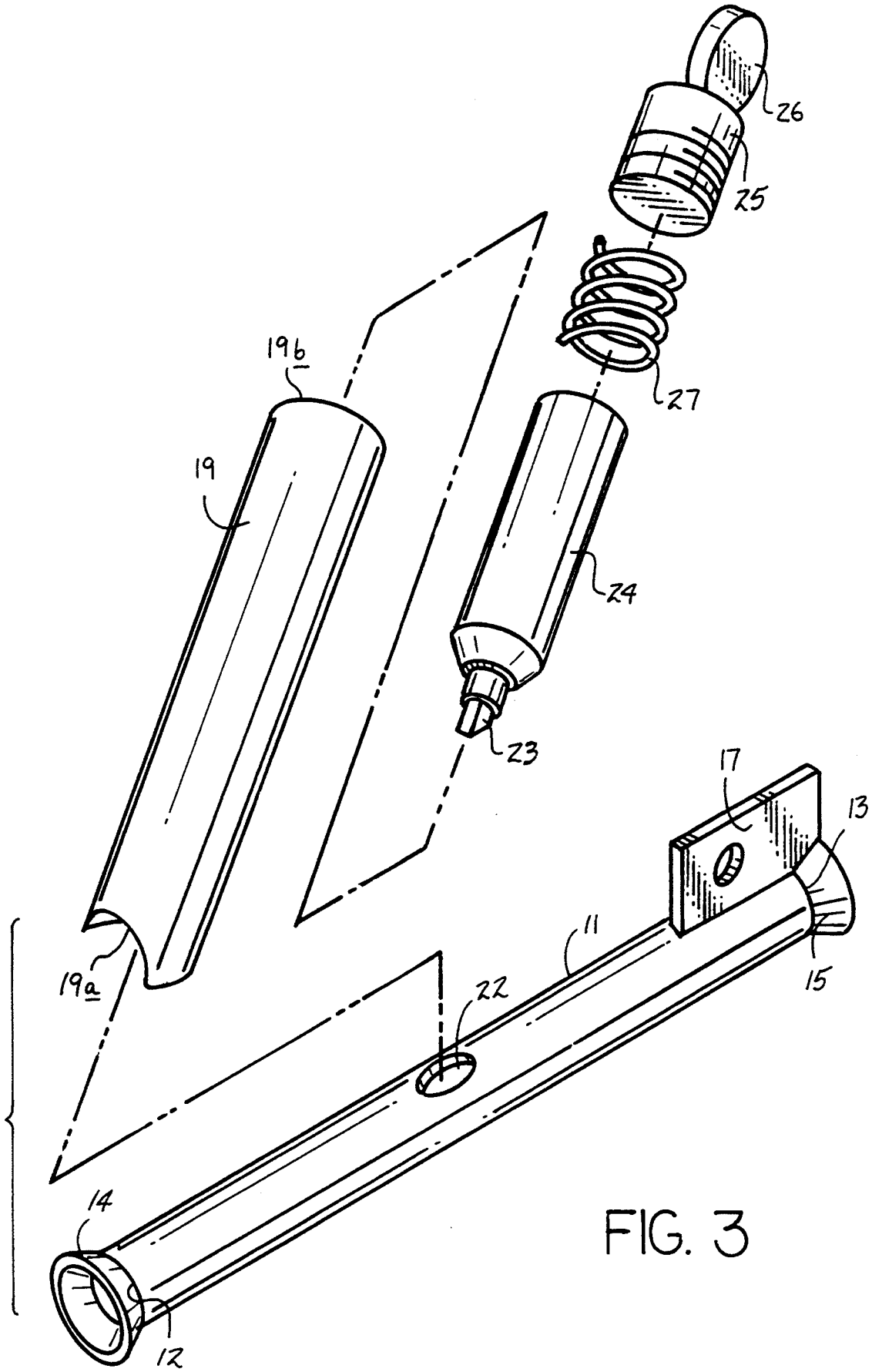
FIG. 3 is an exploded isometric illustration of the invention indicating various components thereof.

More specifically, the wire striper 10 of the instant invention essentially comprises a wire guide tube 11 having a first end 12 spaced from a second end 13, with a first conical guide 14 mounted to the first end and a second conical guide mounted to the second end, with the first and second conical guides, as well as the guide tube, symmetrically oriented about a tube axis 16. A support flange 17 is integrally secured to the guide tube 11 adjacent the second end to secure a chain or other suitable tether 18 to the support flange for ease of transport of the organization. A cylindrical guide housing 19 is integrally mounted to the wire guide tube 11 between the first end and the second end 12 and 13 respectively, and projecting from the wire guide tube to the second end oriented at an acute included angle 20, such as indicated in FIG. 2. The wire guide tube is formed with a guide tube opening 22 directed through the wall of the guide tube, such that the guide housing 19 is arranged with a housing first end 19*a* integrally secured to the wire guide tube, and a housing second end 19*b* spaced from the guide tube such that the housing first end 19*a* is arranged in surrounding relationship relative to the guide tube opening 22. Further, a felt tip marker is positioned within the guide housing, having a marker felt tip 23 projecting through the opening 22 and formed as a part of the marker housing 25, typically forming the reservoir for the fluid directed to the felt tip 23. In this manner, the felt tip 23 oriented within the guide tube with the marker housing 24 arranged to abut the exterior surface of the guide tube is arranged such that a wire fed through the wire feed direction 21, as indicated in FIG. 2, is drawn past the felt tip 23 for marking of the wire in this manner and thereby coating the wire as desired. An externally threaded plug 25 is threadedly received in threaded interengagement with the guide housing at the second end 19*b* , such that a spring 27 is captured between the externally threaded plug 25 and the marker housing 24 to bias the marker housing into abutment with the exterior surface of the guide tube 11. A plug handle 26 fixedly mounted to the plug 25 extends beyond the guide housing 19 for ease of manipulation of the plug 25 to adjust tensioning of the marker housing 24. The spring 27 also permits deflection of the marker housing should wire directed through the guide tube become entangled or the like thereby minimizing damage to the wire or to the felt tip 23 in use.

Figure 4:
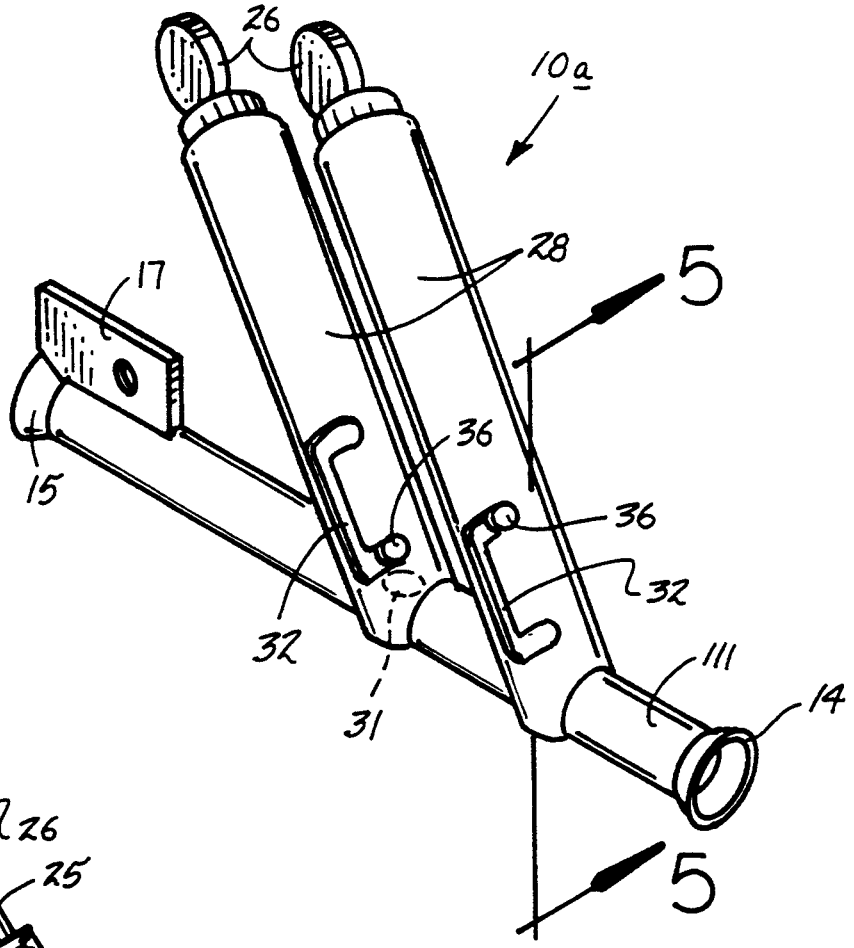
FIG. 4 is an isometric illustration of a modified aspect of the invention.
Figure 5:
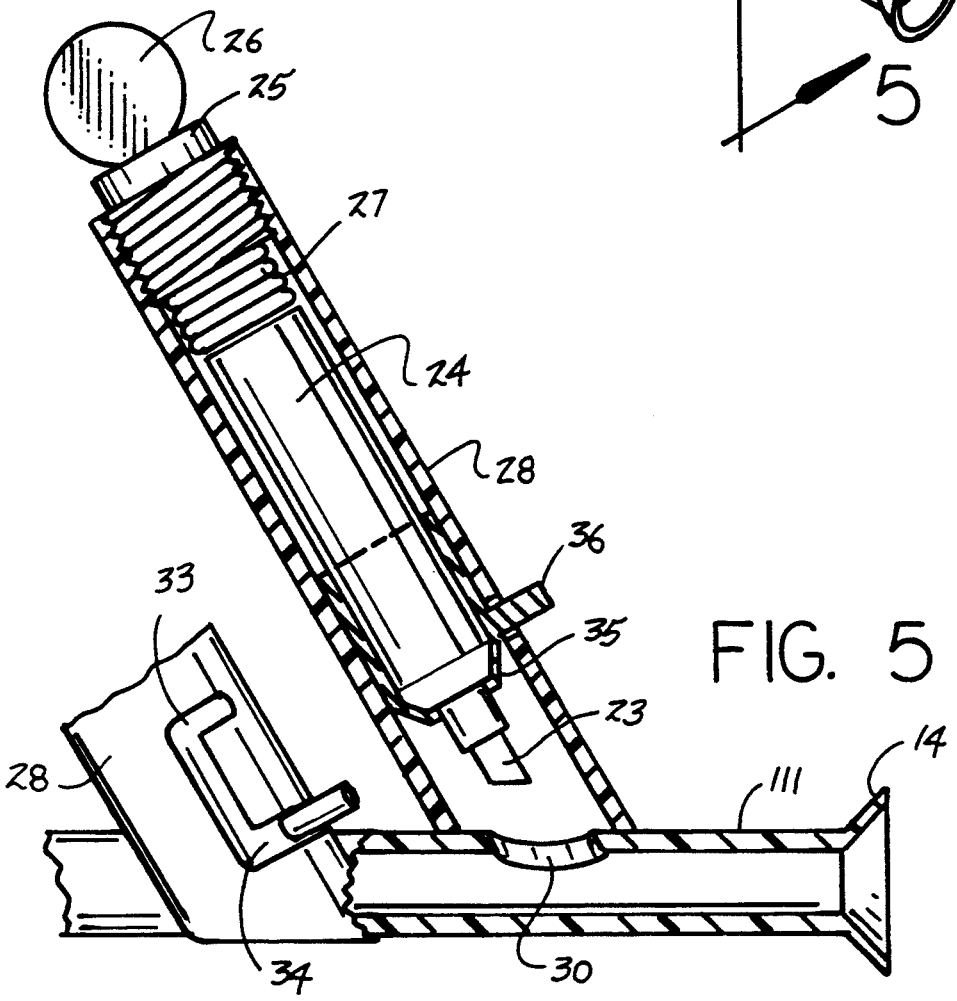
FIG. 5 is an orthographic view, taken along the lines 5—5 of FIG. 4 in the direction indicated by the arrows.

The wire structure 10a, as indicated in FIG. 4, includes a modified guide tube 11I having the first and second conical guides 14 and 15 mounted to its respective first and second ends, in a manner as indicated above, and more specifically to the FIGS. 1 and 2. Additionally, the modified guide tube 111 includes first and second guide tube openings 30 and 31, with a plurality of modified guide housings 28 integrally mounted to the guide tube exterior surface, in a manner as noted above, in surrounding relationship relative to an individual one of the openings 30 and 31. The guide housings 28 are each of identical construction and are configured as described above, but to further include U-shaped slots 32 having upper and lower slot legs 33 and 34 respectively directed into each respective guide housing, such that each housing includes a support cup 35 (see FIG. 5) mounting the marker housing 24 and permitting projection of the felt tip therethrough. To this end, each support cup 35 includes a cup rod 36 extending through the U-shaped slot 32, such that when the rod 36 is in the upper slot leg 33, the marker tip 23 is spaced from the guide tube and when the rod 36 is in the lower slot leg 34, the marker felt tip 23 is oriented within the guide tube, in a manner as indicated in FIG. 2.

Figure 6:
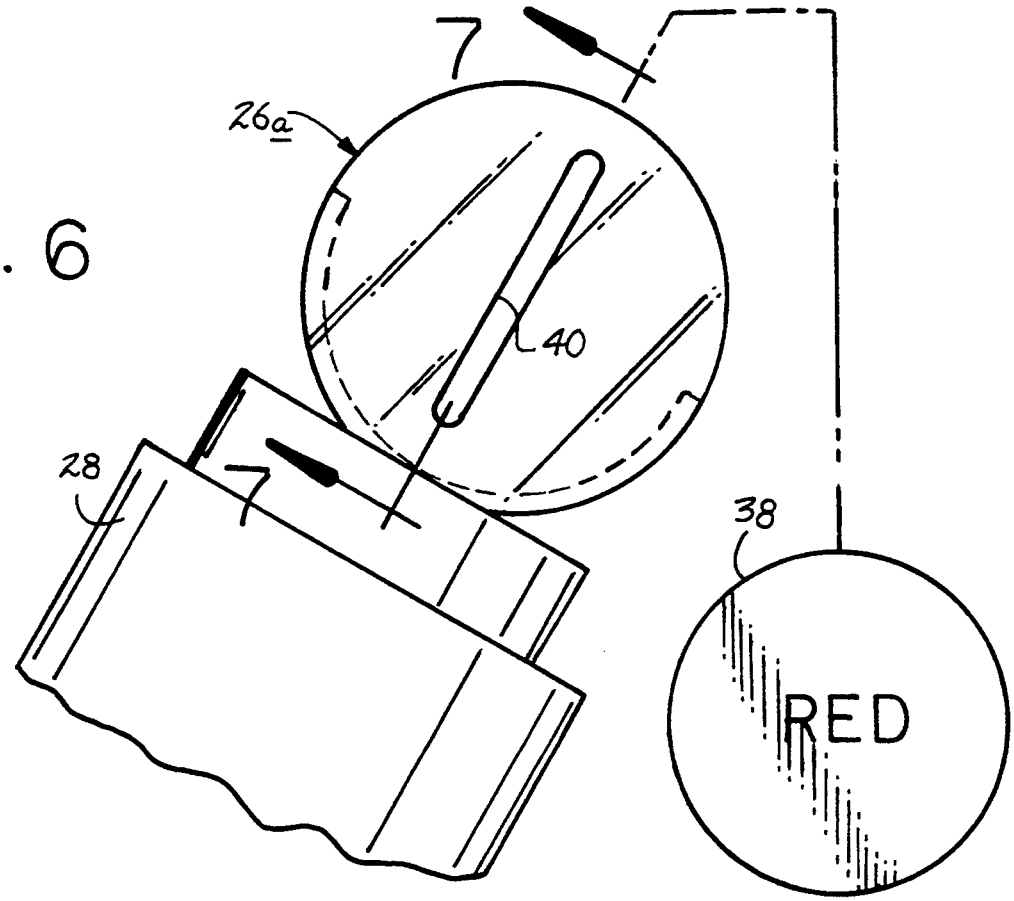
FIG. 6 is an orthographic view of a modified handle for the plug member of the invention.
Figure 7:
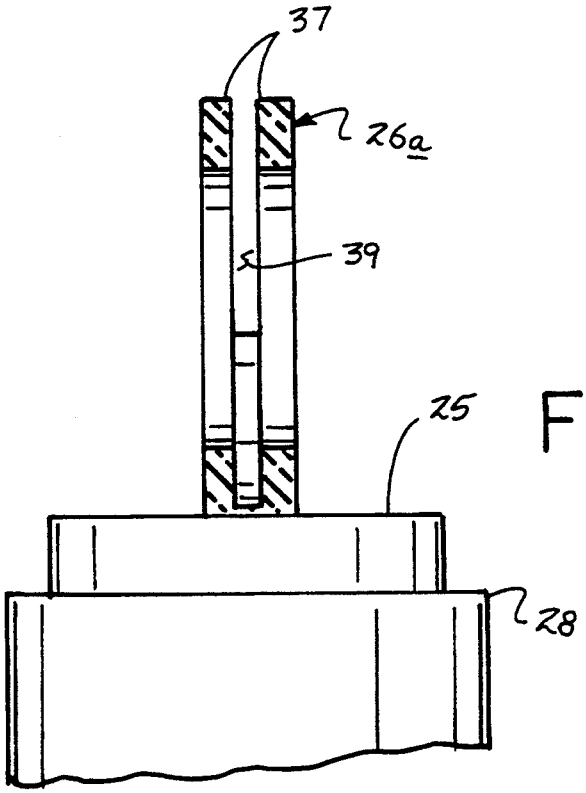
FIG. 7 is an orthographic view, taken along the lines 7—7 of FIG. 6 in the direction indicated by the arrows.

The FIGS. 6 and 7 indicate the use of a modified plug handle 26 having spaced transparent handle flanges 37 to receive an indicator disc 38 frictionally within a handle gap 39 between the handle flanges 37. At least one of the handle flanges 37 is formed with an injector slot 40 to permit receiving a pin or tool and the like within the handle injector slot 40 to engage the indicator disc 38 to enhance its ease of removal relative to the handle gap 39. In this manner, an individual may selectively employ one of a plurality of colors for the striping of wire directed through the modified guide tube 111.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wire striper, comprising, an elongate wire guide tube having a first end spaced from a second end, and a cylinder guide housing integrally mounted to the guide tube, the guide tube symmetrically oriented about a tube axis, and the cylindrical guide housing oriented at an acute included angle relative to the guide tube, with the guide housing canted toward the second end, and the guide housing having a housing first end in integral communication with the guide tube, and a housing second end spaced from the guide tube, with the guide tube having a guide tube wall, and the guide tube wall including a guide tube opening, with the housing first end arranged in surrounding relationship relative to the guide tube opening, and a marker member mounted within the guide housing, having a tip arranged for projection through the guide tube opening, and a marker housing arranged for abutment onto the guide tube wall.

2. A device as set forth in claim 1 wherein the guide housing includes an internally threaded interior surface extending to the housing second end, and an externally threaded plug arranged for reception within the internally threaded portion, with the plug having a plug handle, and a spring captured between the plug and the marker housing.

3. A device as set forth in claim 2 including a further guide housing and a further guide tube opening directed through the guide tube wall, with the further guide housing and the guide housing are arranged in a parallel relationship, and the guide housing and the further guide housing each including a U-shaped slot, each U-shaped slot including an upper slot leg and a lower slot leg, and a plurality of support cups, with one of said support cups mounted within said guide housing and another one of said support cups mounted within said further guide housing, with each support cup including a support cup rod, and each U-shaped slot includes a respective said support cup rod projecting therethrough.

4. A device as set forth in claim 3 wherein the plug handle includes spaced transparent handle flanges having a gap therebetween, and an indicator disc arranged for reception within said gap.

5. A device as set forth in claim 4 wherein one of said flanges includes a slot directed therethrough permitting engagement of the disc for insertion and removal relative to the gap.

* * * * *